US008894894B2

(12) United States Patent
Braithwaite

(10) Patent No.: US 8,894,894 B2
(45) Date of Patent: Nov. 25, 2014

(54) FLUID RECIRCULATION SYSTEM FOR LOCALIZED TEMPERATURE CONTROL AND CHILLING OF COMPRESSED ARTICLES

(75) Inventor: David C. Braithwaite, Palos Hts., IL (US)

(73) Assignee: Air Liquide Industrial U.S. LP, Houston, TX (US)

( * ) Notice: Subject to any disclaimer, the term of this patent is extended or adjusted under 35 U.S.C. 154(b) by 2243 days.

(21) Appl. No.: 11/763,005

(22) Filed: Jun. 14, 2007

(65) Prior Publication Data

US 2008/0196417 A1 Aug. 21, 2008

Related U.S. Application Data

(60) Provisional application No. 60/813,940, filed on Jun. 15, 2006.

(51) Int. Cl.

| | |
|---|---|
| ***B29C 43/02*** | (2006.01) |
| ***B29C 43/52*** | (2006.01) |
| ***F28F 3/12*** | (2006.01) |
| ***F25D 3/10*** | (2006.01) |
| *F25D 29/00* | (2006.01) |
| *F28F 9/02* | (2006.01) |
| *F25B 19/00* | (2006.01) |

(52) U.S. Cl.

CPC ... *F25D 3/10* (2013.01); *F28F 3/12* (2013.01); *F25D 2700/12* (2013.01); *F25D 29/001* (2013.01); *F25B 2700/04* (2013.01); *F28F 9/0246* (2013.01); *F25B 19/005* (2013.01)

USPC ..... 264/28; 264/320; 264/348

(58) Field of Classification Search

None

See application file for complete search history.

(56) References Cited

U.S. PATENT DOCUMENTS

| | | | | |
|---|---|---|---|---|
| 2,998,981 | A | | 9/1961 | Derr |
| 3,708,995 | A | * | 1/1973 | Berg ..... 62/63 |
| 3,743,463 | A | * | 7/1973 | Patrick et al. ..... 425/195 |
| 4,654,094 | A | | 3/1987 | Ritter |
| 4,755,118 | A | * | 7/1988 | Ondush et al. ..... 425/71 |
| 4,887,857 | A | * | 12/1989 | VanOmmeren ..... 141/1 |
| 4,931,232 | A | * | 6/1990 | Lermuzeaux et al. ..... 264/28 |
| 4,943,442 | A | | 7/1990 | Schack et al. |

(Continued)

FOREIGN PATENT DOCUMENTS

EP 0 874 204 10/1998

OTHER PUBLICATIONS

International Search Report for PCT/IB2009/051538, mailed Oct. 5, 2009.

Written Opinion for PCT/IB2009/051538, mailed Oct. 5, 2009.

*Primary Examiner* — Allana Lewin

*Assistant Examiner* — Max Snow

(74) *Attorney, Agent, or Firm* — Allen E. White

(57) ABSTRACT

Systems and methods compress, freeze and store forms at sufficiently low temperatures. A system provides a storage tank of liquefied gas, a gas-liquid separation tank, and a compression chamber. The compression chamber provides compression plates chilled by flow of liquefied gas through conduits traversing an interior volume of the plates. The method comprises recirculating liquefied gas to improve cooling efficiency while lowering operation costs. The system and method further provide for integrated measurement and control of the flow of liquefied gas through the primary components of the system. In one embodiment, the forms are rubber cylinders utilized in the production of torsion axles.

6 Claims, 6 Drawing Sheets

(56) References Cited

U.S. PATENT DOCUMENTS

| | | | | |
|---|---|---|---|---|
| 5,156,008 | A | 10/1992 | Olsson et al. | |
| 5,161,814 | A | 11/1992 | Walker | |
| 5,163,701 | A | 11/1992 | Cromley, Jr. | |
| 5,352,472 | A | 10/1994 | Lucke | |
| 5,520,005 | A * | 5/1996 | Appolonia | 62/63 |
| 5,585,062 | A * | 12/1996 | Muramatsu et al. | 264/314 |
| 5,603,871 | A * | 2/1997 | Koseko et al. | 264/1.9 |
| 6,148,618 | A | 11/2000 | Malmberg et al. | |
| 6,340,165 | B1 | 1/2002 | Kelderman | |
| 6,349,547 | B1 * | 2/2002 | Miller et al. | 62/63 |
| 6,393,860 | B1 | 5/2002 | Heschel et al. | |
| 6,438,990 | B1 | 8/2002 | Hertling | |
| 6,447,073 | B1 | 9/2002 | Goettker | |
| 6,620,354 | B1 * | 9/2003 | Bessemer et al. | 264/40.6 |
| 6,634,880 | B2 * | 10/2003 | Cazzani | 425/326.1 |
| 6,895,775 | B2 | 5/2005 | Newman et al. | |
| 6,986,874 | B2 | 1/2006 | Satchell, Jr. et al. | |
| 6,997,053 | B2 | 2/2006 | Forshey et al. | |
| 7,055,333 | B2 | 6/2006 | Leitch et al. | |
| 2002/0083727 | A1 * | 7/2002 | Koike et al. | 62/258 |
| 2003/0062654 | A1 * | 4/2003 | Lamkin | 264/250 |
| 2004/0103672 | A1 | 6/2004 | Newman et al. | |
| 2004/0216470 | A1 * | 11/2004 | Thomas et al. | 62/63 |
| 2006/0051451 | A1 * | 3/2006 | Hutchinson et al. | 425/552 |
| 2006/0074916 | A1 * | 4/2006 | Beary | 707/10 |

* cited by examiner

FLUID RECIRCULATION SYSTEM FOR LOCALIZED TEMPERATURE CONTROL AND CHILLING OF COMPRESSED ARTICLES

CROSS-REFERENCE TO RELATED APPLICATIONS

This application claims the benefit under 35 U.S.C. §119 (e) to provisional application No. 60/813,940, filed Jun. 15, 2006, the entire contents of which are incorporated herein by reference.

BACKGROUND

Molded rubber products are required for a variety of industrial uses. For certain applications, the rubber must be highly compressed during intermediate stages of production. In order to maintain the rubber in a highly compressed form during such intermediate stages, the rubber may be held at cryogenic temperatures. In subsequent stages of production, the rubber expands as it returns to ambient temperatures.

Liquefied gases, such as liquid nitrogen, may be used to achieve the cryogenic temperatures required to maintain rubber in a highly compressed form. However, rubber tends to absorb liquid nitrogen upon direct contact, thereby becoming brittle and susceptible to fracturing. Existing methods for chilling highly compressed rubber forms therefore apply liquid nitrogen to the external surfaces of compression plates. The rubber is then conductively chilled by the interior surfaces of the compression plates. For example, a manifold of nozzles may spray liquid nitrogen onto the external surface of a compression plate. As the stream of liquid nitrogen flows towards the external surface, a significant portion of the stream vaporizes, thereby reducing the cooling efficiency and increasing the cost of operation of the system due to the consumption of nitrogen. Another significant portion of the stream is directed away from the surface of the plate, also reducing the cooling efficiency of the stream. Finally, once compressed and chilled, the rubber must be stored at the extremely low temperatures pending subsequent production steps, thereby requiring additional cryogenic systems.

Therefore, what is required is a mechanism and process for more efficiently compressing, chilling, and storing rubber or elastomer forms at extremely low temperatures.

SUMMARY

Embodiments of the present invention relate to devices and methods for compressing, freezing and storing rubber or other elastomer forms at sufficiently low temperatures. One embodiment provides a recirculation system for a liquefied gas, such as nitrogen, helium, or carbon dioxide and/or a secondary refrigerant, such as d-limonene. The system includes a first compression body of a compression chamber, wherein a fluid passageway traverses an interior volume of the first compression body between an inlet and an outlet of the fluid passageway, and a second compression body of the compression chamber, wherein the first and second compression bodies have corresponding mating faces that are moveable relative to one another and define an interface between which elastomeric forms are compressible. The system further includes a first source of refrigeration liquid fluidly coupled to the inlet of the fluid passageway via a supply line and coupled to the outlet of the fluid passageway via a return line.

In one embodiment, a method provides for compressing and freezing rubber forms. The method includes circulating a liquefied gas through a circulation loop by flowing the liquefied gas from a source of the liquefied gas to an inlet of a compression chamber, flowing the liquefied gas through the compression chamber, whereby the compression chamber is cooled, removing the liquefied gas from an outlet of the compression chamber, and flowing the removed liquefied gas back to the source. The method further includes compressing an elastomeric form within an interface of the compression chamber, and maintaining compression of the elastomeric form for a time period sufficient to freeze the elastomeric form in a compressed state, wherein the circulating is preformed during at least a portion of the compressing and maintaining steps.

For one embodiment, a method provides utilization of compressed and frozen rubber forms in the assemblage of a torsion axle. The method includes chilling a first compression plate and a second compression plate with a liquefied gas, wherein the liquefied gas flows through a plurality of conduits traversing respective interior volumes of each of the first and second compression plates, compressing a plurality of elastomeric forms between the first and second compression plates, maintaining compression of the elastomeric forms for a time period sufficient to freeze the elastomeric forms in a compressed state, storing the elastomeric forms in the compressed state in a storage chamber, maintaining the temperature of the storage chamber to a specified storage temperature range, inserting one or more of the elastomeric forms in the compressed state between a torsion axle housing and a torsion axle shaft, and expanding the elastomeric forms inserted upon warming of the elastomeric forms.

BRIEF DESCRIPTION OF THE DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF PREFERRED EMBODIMENTS

Embodiments of the invention provide devices and methods for compressing, freezing, and storing articles of manufacture (e.g., rubber forms) at very low temperatures. Such embodiments recirculate liquefied gas to improve cooling efficiency while lowering operation costs.

Figure 1:
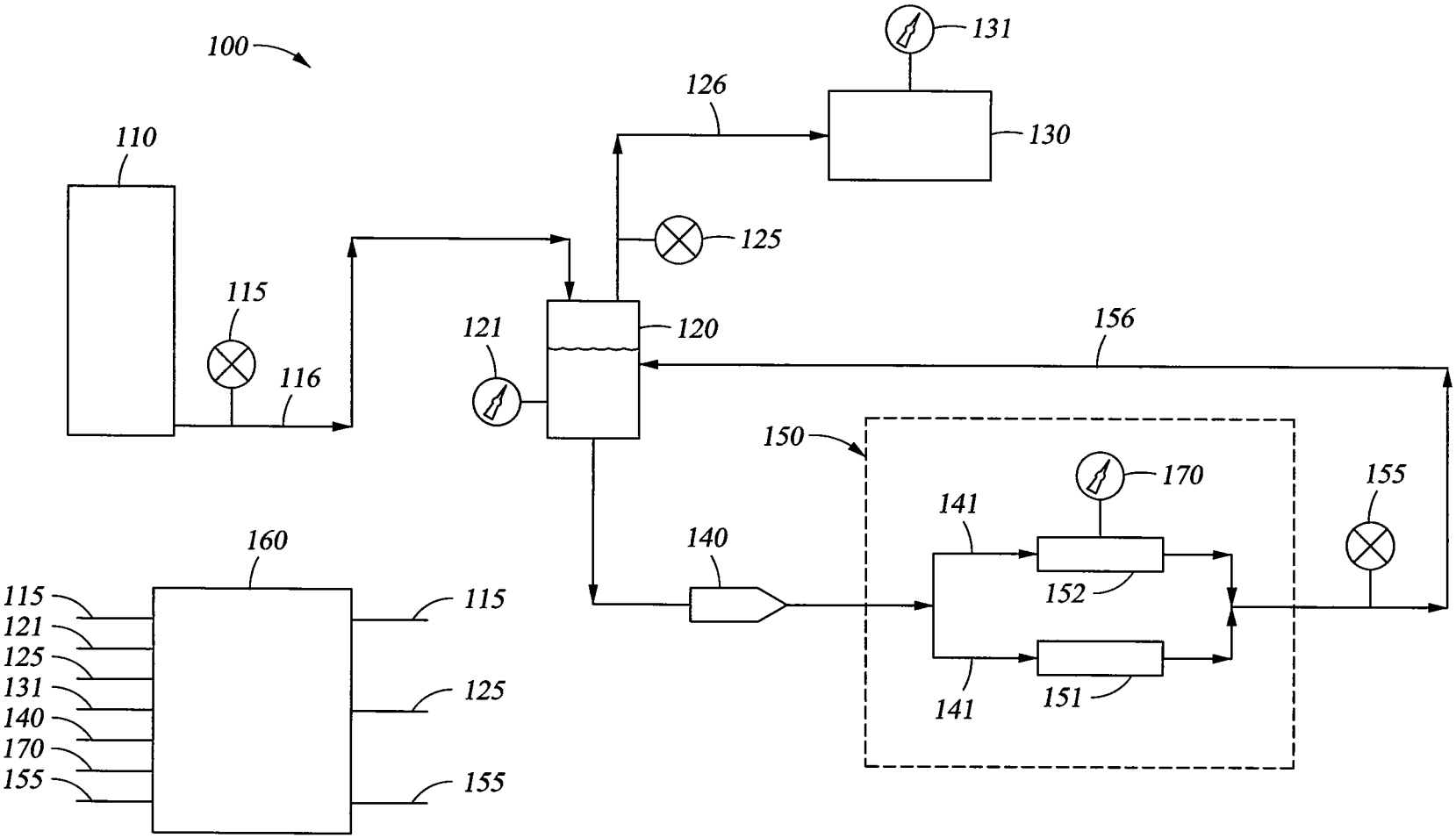
FIG. 1 illustrates the primary components of an exemplary recirculation system.

FIG. 1 illustrates one embodiment of an exemplary liquefied gas recirculation system 100. As depicted, the recirculation system provides a circuit for the flow of liquefied gas, whereby liquefied gas may be provided from a source, to a point of use and then recirculated back to the source. It should be appreciated that the recirculation system 100 may include any number of inlets and outlets, e.g., to provide improved performance. It should also be appreciated that a secondary refrigerant, such as d-limonene, could be used in place of or in conjunction with (either mixed with or isolated from) the recirculated liquefied gas. The secondary refrigerant may be mechanically or cryogenically chilled and may include any liquid that is capable of being chilled to below 100° C., for example. For improved cooling efficiency, any or all of the components of the liquefied gas recirculation system 100 may be insulated from external temperatures, such as through the use of vacuum jackets or urethane coatings.

In one embodiment of the invention, a storage tank 110 may provide a reservoir of liquefied gas. It should be appreciated by those skilled in the art that any one of a number of liquefied gases could be selected, including gases such as nitrogen, helium, or carbon dioxide, depending on the target temperature requirements. For the purposes of illustration and without limitation, in this example, nitrogen is utilized as the recirculated liquefied gas. The rate of flow of a first liquid nitrogen stream 116 from the storage tank 110 may be controlled by a first flow control valve 115. The first liquid nitrogen stream 116 may be introduced into a gas-liquid separation tank 120. The amount of liquid nitrogen contained in the gas-liquid separation tank 120 may be measured by a load cell or other liquid content measurement device 121. In one embodiment, the first flow control valve 115 and the liquid content measurement device 121 may communicate with a control device 160 to provide integrated measurement and control of the amount of liquid nitrogen introduced into the gas-liquid separation tank 120.

The gas-liquid separation tank 120 may serve as a reservoir of nitrogen vapor for a cryogenic storage unit 130. The rate of flow of a nitrogen vapor stream 126 may be controlled by a second flow control valve 125. The temperature of the cryogenic storage unit 130 may be measured by a first temperature measurement device 131. In one embodiment, the second flow control valve 125 and the first temperature measurement device 131 may communicate with the control device 160 to provide integrated measurement and control of the amount of nitrogen vapor introduced into the cryogenic storage unit 130. In one embodiment, the temperature of the cryogenic storage unit 130 may be maintained at an identified temperature and pressure to retain contents within the storage unit 130 in a state of compression as introduced into the storage unit 130, for example, at about −250° C. or about −100° C. to about −300° C.

The gas-liquid separation tank 120 may also serve as a recirculation reservoir for a compression chamber 150. A second liquid nitrogen stream 141 may be drawn from the gas-liquid separation tank 120 by a pump 140. The second liquid nitrogen stream 141 may then traverse first and second compression plates 151, 152, thereby providing cryogenic convective-conductive cooling of the plates 151, 152. A resultant liquid nitrogen/nitrogen vapor stream 156 may be returned to the gas-liquid separation tank 120. The rate of flow of the liquid nitrogen/nitrogen vapor stream 156 exiting the compression chamber 150 may be controlled by a third flow control valve 155. The temperature of the compression chamber 150 may be monitored by a second temperature measurement device 170. In one embodiment, the pump 140, the third flow control valve 155, and the second temperature measurement device 170, may communicate with the control device 160 to provide integrated measurement and control of the residence time of nitrogen in the compression plates 151, 152, thereby controlling the temperature of the compression chamber 150. It should be appreciated that the locations of the pump 140 and the third flow control valve 155 are interchangeable. Although FIG. 1 shows the second temperature measurement device 170 directly connected to the second compression plate 152, it should be appreciated that a variety of other configurations would provide appropriate measurements of the temperature of the compression chamber 150. In one embodiment, the temperature of the compression chamber 150 may be maintained within a range of −260° C. to −250° C.

Although the streams 116, 126, 141, 156 are illustrated as individual streams, it should be understood that portions of each stream may be removed for other purposes not shown in FIG. 1. For some embodiments, the cryogenic storage unit 130 may be omitted such that the nitrogen vapor stream 126 may be vented or liquefied by cooling and compressing prior to returning to the storage tank 110. At least the liquid nitrogen streams 116, 141, the liquid nitrogen/nitrogen vapor stream 156 and passage through the compression chamber 150, may together define a sealed or closed environment preventing loss of nitrogen.

In one embodiment, the control device 160 continuously communicates with the flow control valves 115, 125, 155, the liquid content measurement device 121, the temperature measurement devices 131, 170, and the pump 140 to provide integrated measurement and control of all aspects of the liquefied gas recirculation system 100. In an alternative embodiment, the control device 160 communicates sequentially with the various components as necessitated by the production process.

Figure 2A:
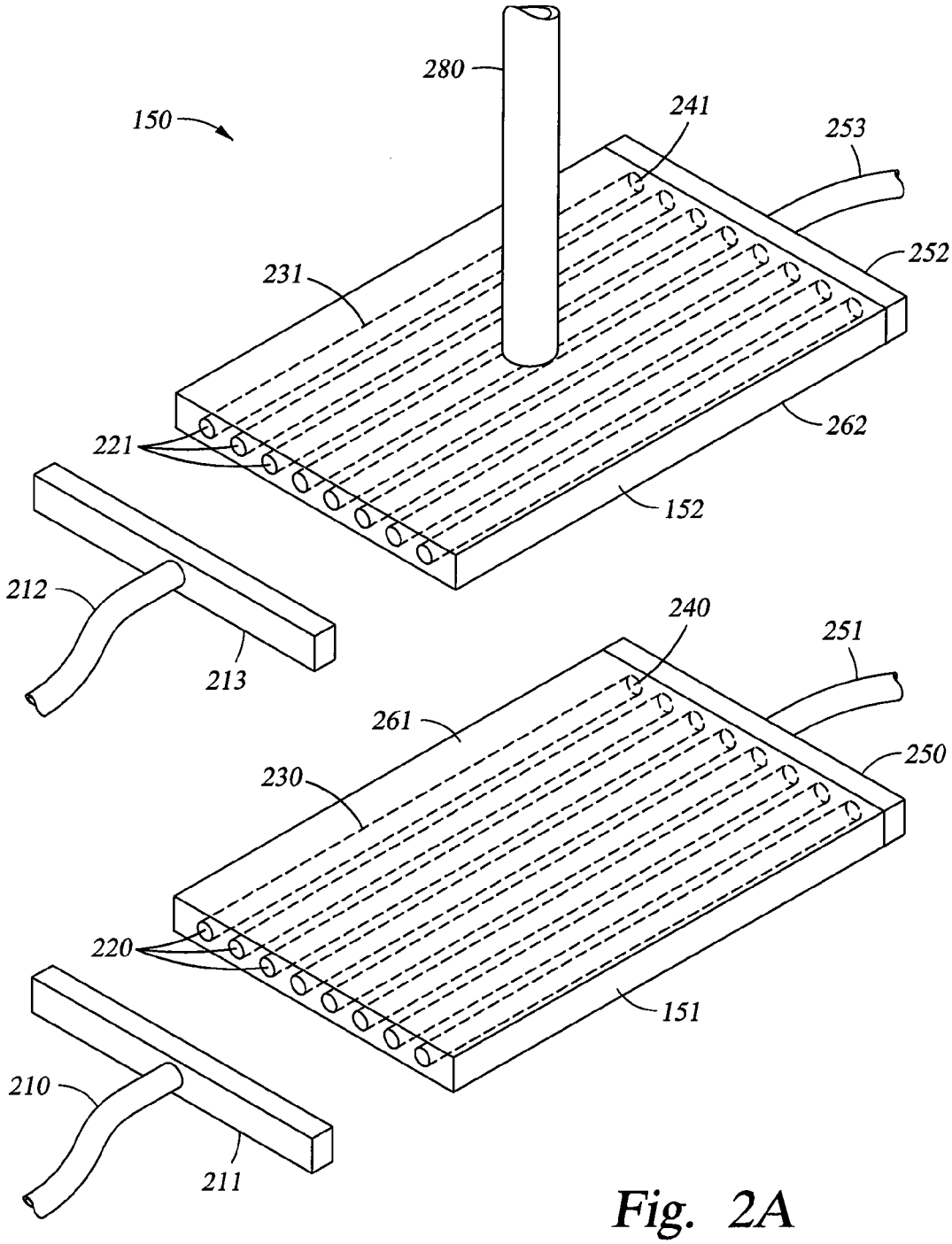
FIGS. 2A and 2B illustrate an exemplary compression chamber.
Figure 2B:
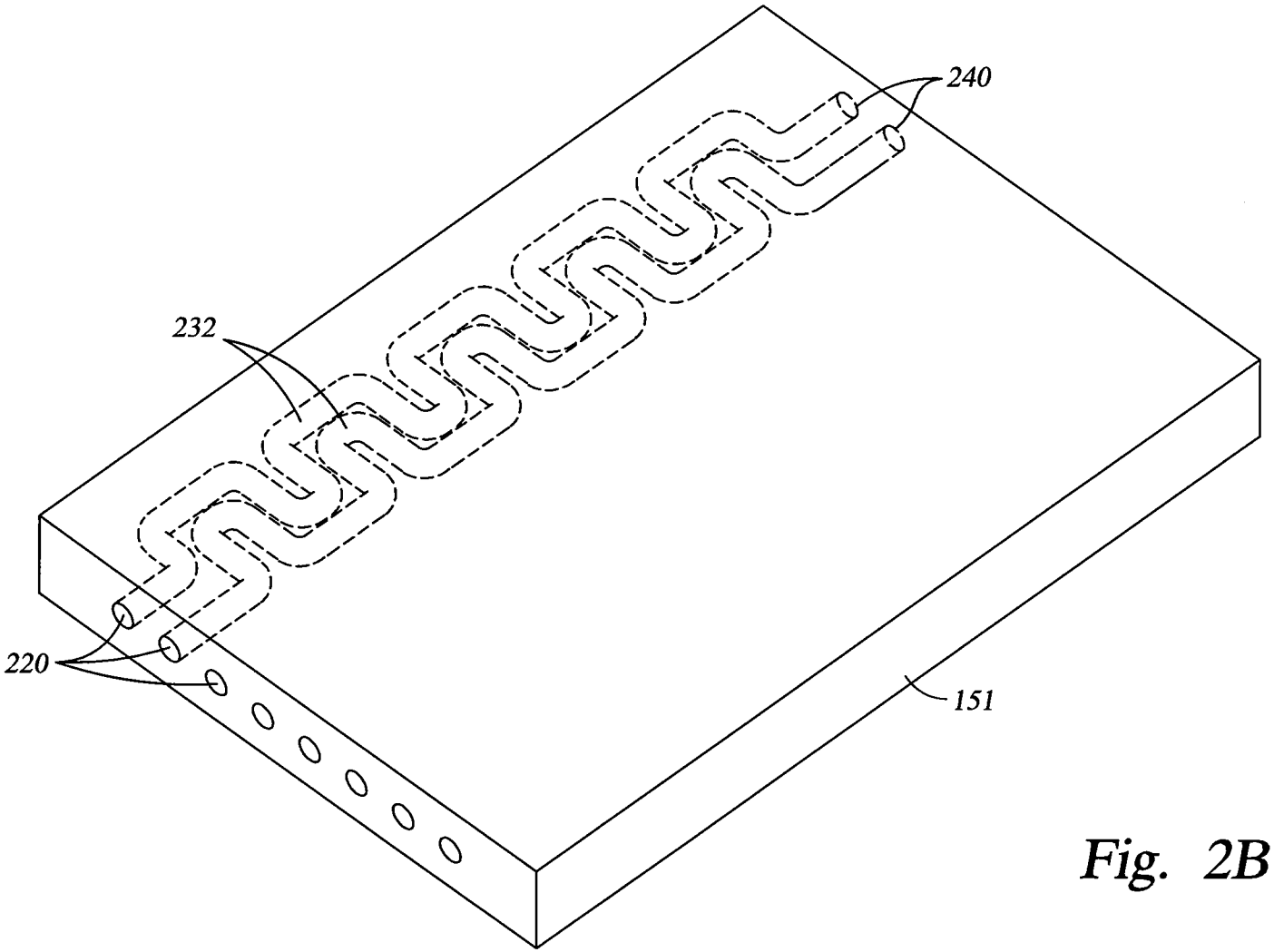

FIG. 2A illustrates one example of the compression chamber 150. The second liquid nitrogen stream 141 may enter the compression chamber 150 through flexible first and second input tubing 210, 212, which may be connected respectively to the first and second compression plates 151, 152 via first and second input manifolds 211, 213, respectively. The second liquid nitrogen stream 141 may be divided into a plurality of streams by the input manifolds 211, 213 for respective introduction into first and second plurality of inlet holes 220, 221. Liquid nitrogen may flow through the first and second plurality of inlet holes 220, 221 into respective first and second plurality of conduit passageways 230, 231, which may traverse the volume of the compression plates 151, 152. Although FIG. 2A illustrates straight conduit passageways 230, 231, it should be appreciated that the conduit passageways 230, 231 could follow curved trajectories to provide for longer path length, thereby greater residence time for any given flow rate. An example of a possible curved trajectory conduit path 232 is illustrated in FIG. 2B. It should also be appreciated that while bore diameters may be constant across the length of the conduit passageways 230, 231, the bore diameters may also vary across the length of the conduit passageways 230, 231 to permit flow concentration at certain locations. A mixture of liquid nitrogen and nitrogen vapor may exit the conduit passageways 230, 231 through respective first and second plurality of outlet holes 240, 241. First and second output manifolds 250, 252 facilitate coalescing of exiting streams into the liquid nitrogen/nitrogen vapor stream 156, which flows out of the compression chamber 150 through flexible first and second output tubing 251, 253 coupled respectively to the first and second output manifolds 250, 252.

In one embodiment, elastomeric forms (e.g., rubber forms) may be inserted between the compression plates 151, 152. Pressure may be applied to the compression plates 151, 152 by a pressure source 280. This application of pressure may cause the elastomeric forms to be compressed against first and second contact surfaces 261, 262 of respectively the first and second compression plates 151, 152. Although FIG. 2A illustrates the pressure source 280 working directly on the second compression plate 152, it should be appreciated that pressure could be applied to either or both of the compression plates 151, 152. In one embodiment, the aggregate pressure applied to the elastomeric forms at the contact surfaces 261, 262 may be in the range of 600 kPa to 60,000 kPa.

Although FIG. 2A illustrates the first input manifold 211, for example, as a single (unitary) structure, it should be appreciated that each of the first plurality of inlet holes 220 may be individually connected to flexible first input tubing 210 via a connection substructure of a manifold assembly. The individual connections may be CGA-295 cryogenic fittings, dissimilar metal bayonet connections or other cryogenic fittings commonly known in the art. Additionally, it should be appreciated that the tubing 210, 212, 251, 253 may be constructed from a variety of cryogenic hoses known in the art, including both flexible and fixed transfer hoses.

Although FIG. 2A illustrates each of the first plurality of inlet holes 220, for example, breaching the perimeter of the first compression plate 151 from only one side, it should be appreciated that the first plurality of inlet holes 220 may exist on multiple sides of the first compression plate 151. For example, in one embodiment, gas flows in opposite directions in adjacent ones of the first plurality of conduit passageways 230, necessitating alternating the first plurality of inlet holes 220 and first plurality of outlet holes 240 on one side of the first compression plate 151. One skilled in the art will appreciate that the temperature at specified points on the first contact surface 261 of the first compression plate 151 can be more precisely controlled by customizing the configuration of the first plurality of conduit passageways 230 and the direction of gas flow through each of the first plurality of conduit passageways 230. Similar variations may occur in configuration and flow direction for the second plurality of conduit passageways 231 within the second compression plate 152.

FIG. 3 illustrates two possible alternative embodiments for the first compression plate 151. It should be appreciated that similar alternatives may apply to second compression plate 152. In one embodiment, a width W of the first compression plate 151 may be about three feet. A length L of the first compression plate 151 may be about four feet, for one embodiment. The width W and the length L may vary to accommodate rubber forms of various shapes and sizes. Similarly, the first compression plate 151 may take any variety of shapes, such as the shape of an ellipse or polygon, to better accommodate production requirements. The first compression plate 151 may be made of a heat-conductive material, such as aluminum, carbon steel, or stainless steel.

Figure 3A:
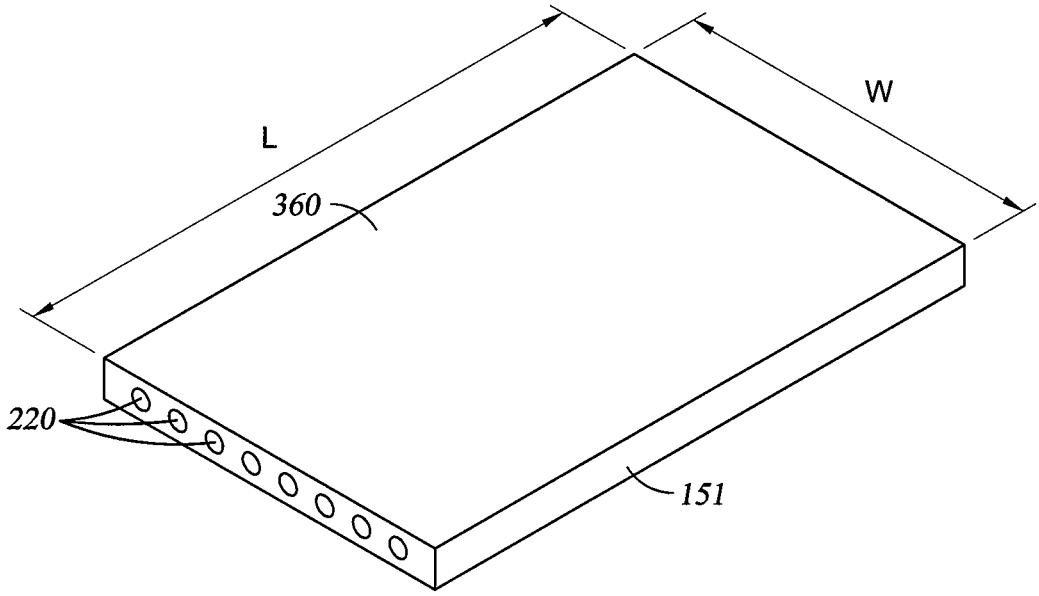
FIGS. 3A and 3B illustrate two possible alternative embodiments for compression plates.
Figure 3B:
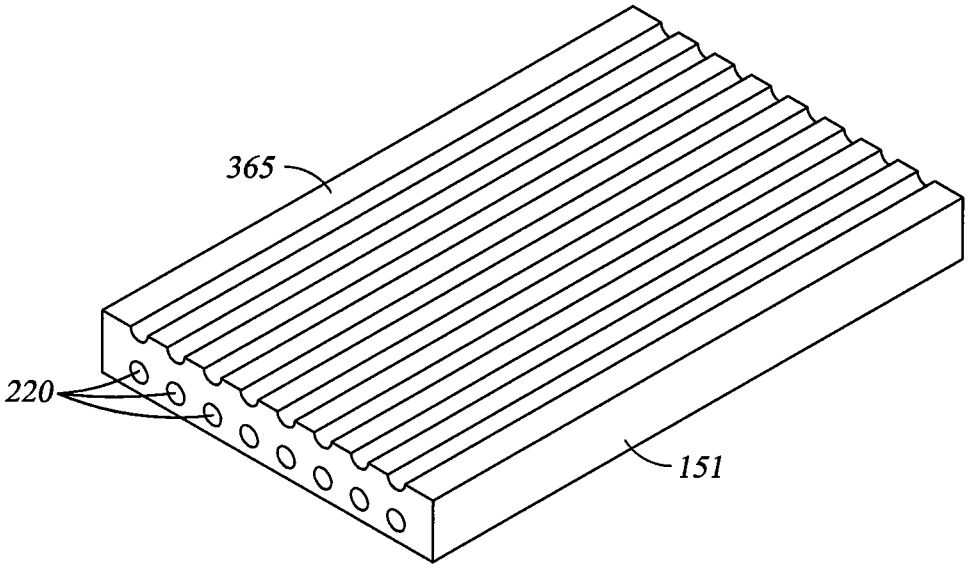

FIG. 3A illustrates one embodiment, wherein the first contact surface 261 of the first compression plate 151 may be a flat surface 360. FIG. 3B illustrates an alternative embodiment, wherein the first contact surface 261 of the first compression plate 151 may be a grooved surface 365 to accommodate the elastomeric forms and define the shape into which the elastomeric forms are compressed. It should be appreciated that the surface structure of the first contact surface 261 may be varied to accommodate elastomeric forms of various shapes and sizes. In one embodiment, the first contact surface 261 may be removable so that interchangeable contact surface molds may be attached to the first compression plate 151 to achieve the appropriate contact surface structure.

Although FIG. 3B illustrates a one-to-one correspondence between the first plurality of inlet holes 220 and the recesses of the grooved surface 365, it should be appreciated that a variety of configuration alternatives exist. For example, in one embodiment, each recess may be flanked by a pair of the first plurality of conduit passageways 230, with gas flowing in opposite directions in the two conduit paths. In another embodiment, for N recesses, there may be N+1 conduit paths, wherein a single one of the first plurality of conduit passageways 230 runs between each recess and along the lateral sides of recesses 1 and N.

FIG. 4 illustrates an exemplary torsion axle assembly. The recirculation system 100 may be used to compress and freeze rubber rods as an intermediate step in the production of torsion axle 400. In one embodiment, rubber rods may be compressed and frozen in the shape of half-cylinders 430. While still frozen, the half-cylinders 430 may be inserted between an axle housing 410 and an axle shaft 420. With thermalization, the rubber rods may expand into full cylinders 431, thereby providing shock protection for the torsion axel 400. It should be appreciated that torsion axles may be constructed from square tubing, as illustrated, or from triangular, hexagonal, or other polygonal shaped tubing.

Figure 5:
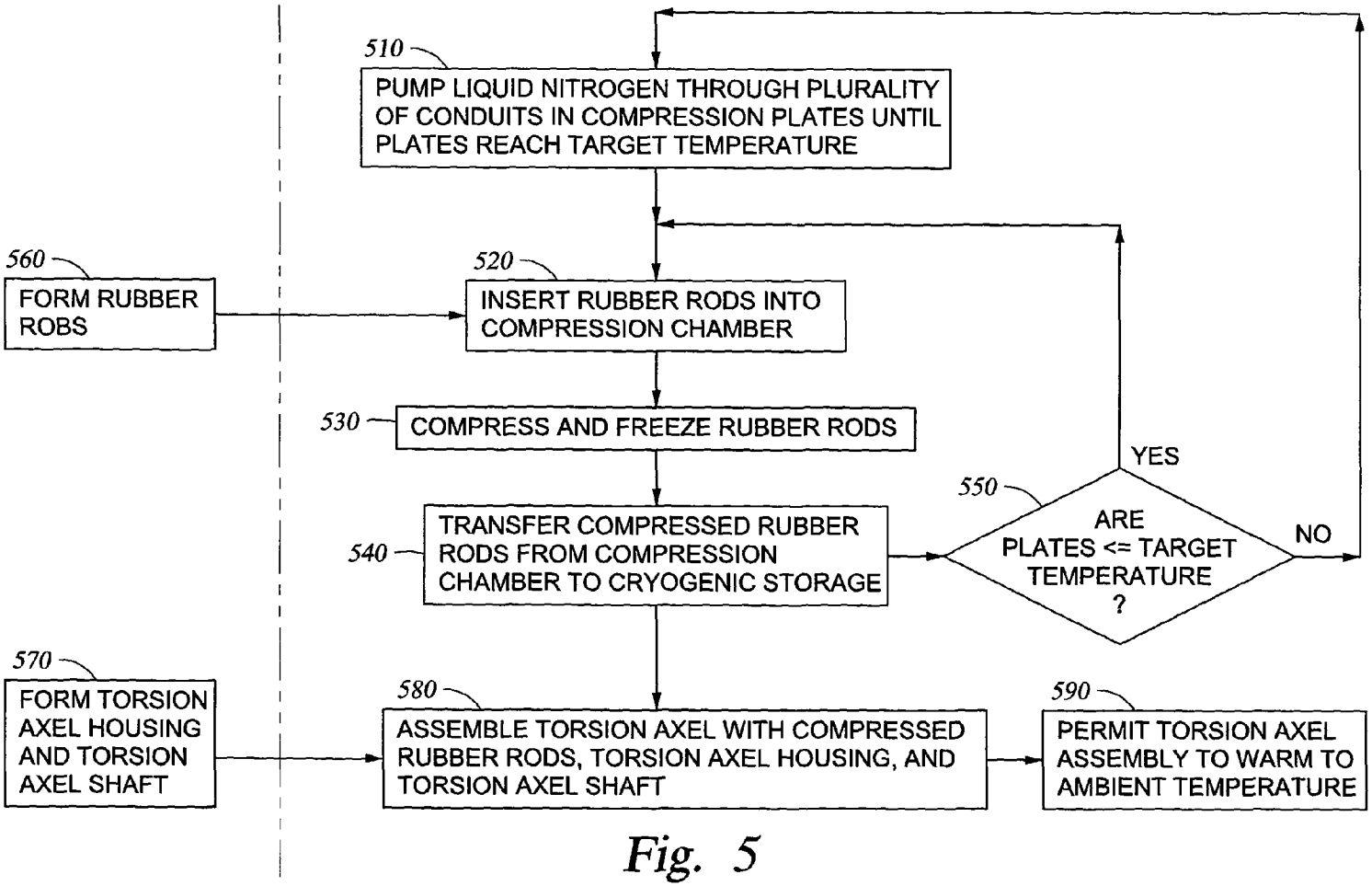
FIG. 5 diagrams the steps involved in the assemblage of torsion axles utilizing the recirculation system.

FIG. 5 diagrams the steps involved in the production of torsion axles utilizing the recirculation system 100. The recirculation system 100 may be initially prepared in preliminary step 510 by flowing liquid nitrogen through the compression plates 151, 152 until they reach a specified target temperature. In one embodiment, the target temperature may be −260° C. Although FIG. 5 illustrates the flow of liquid nitrogen through the compression plates 151, 152 as a discrete step, it should be appreciated that the control device 160 may be active throughout the production process to control the flow of gas to each of the components of the recirculation system 100.

In insertion step 520, rubber rods—previously formed in manufacturing step 560—may be inserted between the compression plates 151,152. In one embodiment, the diameter of the rubber rods may be between about one-quarter to one inch. If the first contact surface 261 of the first compression plate 151 is grooved, the rubber rods may be inserted into the recesses.

The pressure source 280 may act on the second compression plate 152 in compressing step 530 to compress the rubber rods between the contact surfaces 261, 262. In one embodiment, pressure may be applied for up to about five seconds. While being compressed, the rubber rods may freeze to a temperature of about −260° C. to −250° C. due to conductive contact with the contact surfaces 261, 262.

Figure 4A:
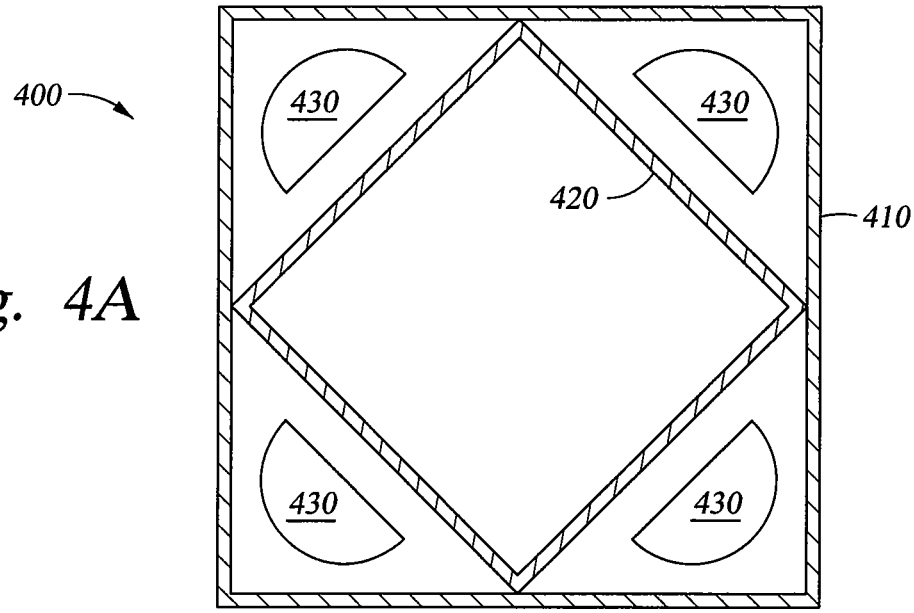
FIGS. 4A and 4B illustrate an exemplary torsion axle assembly.
Figure 4B:
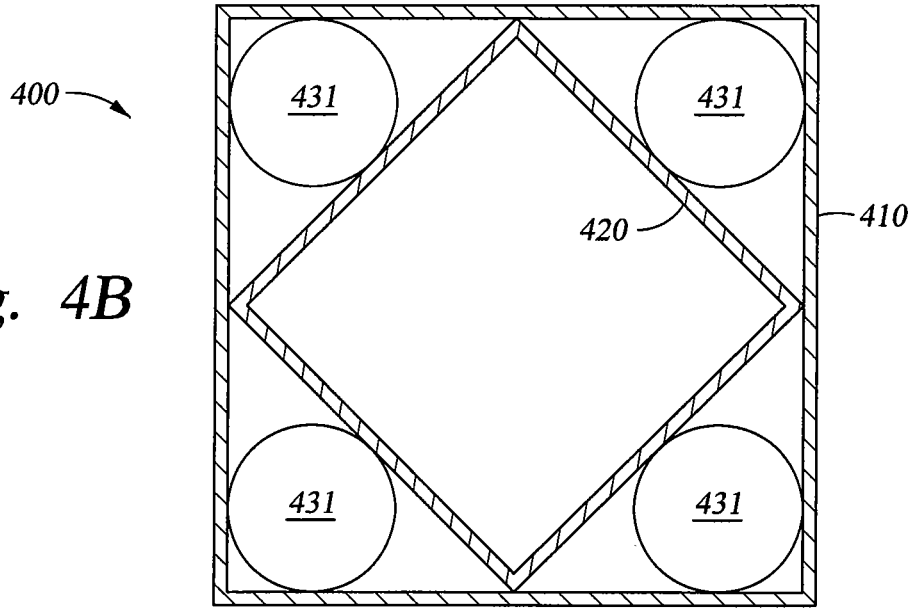

At transfer step 540, the compressed and frozen rubber rods may be transferred from compression the chamber 150 to the cryogenic storage unit 130. The compressed and frozen rubber rods may be stored pending other processing steps, such as formation of an axle housing and axel shaft in fabrication step 570. The cryogenic storage unit 130 may thus only temporarily maintain the rods chilled such as may be required during transfer to an assembly location where the rods are utilized. In one embodiment, about twenty to thirty compressed and frozen rubber rods may be stored for up to about four hours. When the control device 160 does not act continuously throughout the production process, control step 550 may provide for reset of the recirculation system 100 to prepare for processing of subsequent sets of rubber rods. Finally, in assembly and warming steps 580, 590, the torsion axle 400 may be assembled by inserting the axle shaft 420 in the axle housing 410 and disposing the rubber rods, while still the half-cylinders 430, about the axle shaft 420 and within the axel housing 410, as illustrated in FIGS. 4A and 4B.

It will be understood that many additional changes in the details, materials, steps, and arrangement of parts, which have been herein described and illustrated in order to explain the nature of the invention, may be made by those skilled in the art within the principle and scope of the invention as expressed in the appended claims. Thus, the present invention is not intended to be limited to the specific embodiments in the examples given above and/or the attached drawings.

What is claimed is:

1. A method for compressing and freezing elastomeric forms, comprising:

circulating a liquefied gas through a circulation loop, the circulating comprising:

flowing the liquefied gas from a source of the liquefied gas to an inlet of a compression chamber;

flowing the liquefied gas through the compression chamber, whereby the compression chamber is cooled;

removing the liquefied gas from an outlet of the compression chamber; and flowing the removed liquefied gas back to the source;

compressing an elastomeric form within an interface of the compression chamber;

maintaining compression of the elastomeric form for a time period sufficient to freeze the elastomeric form in a compressed state, wherein the circulating is performed during at least a portion of the compressing and maintaining steps;

cooling a storage chamber utilizing exhausted liquefied gas vapor from the source of liquefied gas;

storing the elastomeric form in the compressed state in the storage chamber;

monitoring the temperature of the storage chamber; and controlling flow of the exhausted liquefied gas vapor to the storage chamber to maintain the temperature of the storage chamber in a specified storage temperature range.

2. The method of claim 1, wherein the liquefied gas is one of nitrogen, helium, and carbon dioxide.

3. The method of claim 1, wherein the circulating includes passing the liquefied gas through a fluid passageway traversing an interior volume of a first compression plate of the compression chamber, wherein the first compression plate mates with a second compression plate of the compression chamber during the compressing to provide the interface.

4. The method of claim 1, further comprising:

monitoring temperature of the compression chamber; and controlling flow rate of the circulating liquefied gas to maintain temperature of the compression chamber to a specified compression temperature range.

5. The method of claim 1, wherein compressing the elastomeric form changes a shape of the elastomeric form from a cylinder to a half-cylinder.

6. The method of claim 1, wherein the elastomeric form is a rubber form.

* * * * *